US006304029B1

(12) United States Patent
De Bot et al.

(10) Patent No.: US 6,304,029 B1
(45) Date of Patent: Oct. 16, 2001

(54) LOW PRESSURE MERCURY DISCHARGE LAMP HAVING A MERCURY HOLDER WITH REDUCED LEAD OXIDE

(75) Inventors: Frank Gerardus Cornelis De Bot; Johannes A. G. Van Dongen; Frans J. Traksel, all of Roosendaal (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/263,922

(22) Filed: Mar. 5, 1999

(30) Foreign Application Priority Data

Mar. 19, 1998 (EP) ..... 98200883

(51) Int. Cl.[7] ..... H01J 1/62; H01J 63/04; H01J 17/26; H01J 17/22; H01J 19/70

(52) U.S. Cl. ..... 313/493; 313/546; 313/564; 313/565; 313/550; 313/634; 313/490; 445/9; 445/10; 445/38; 445/73

(58) Field of Search ..... 313/490, 493, 313/546, 563–567, 549–551, 634, 552, 556, 558–559; 445/9–10, 38–43, 73; 301/64, 66–69, 70–72

(56) References Cited

U.S. PATENT DOCUMENTS

| | | | | |
|---|---|---|---|---|
| 3,794,402 | * | 2/1974 | Ridders et al. | 313/546 X |
| 3,794,403 | * | 2/1974 | Ridders et al. | 313/546 X |
| 4,182,971 | * | 1/1980 | Cassidy et al. | 313/546 |
| 4,278,908 | * | 7/1981 | Antonis | 313/546 |
| 4,335,326 | * | 6/1982 | Latassa et al. | 313/546 |

* cited by examiner

*Primary Examiner*—Nimeshkumar D. Patel
*Assistant Examiner*—Mack Haynes
(74) *Attorney, Agent, or Firm*—Dicran Halajian

(57) ABSTRACT

A method of manufacturing a low-pressure mercury vapor discharge lamp starting from a discharge vessel (10) wherein a closed holder (22) is placed which is provided with a quantity of one or more substances to be introduced in the discharge vessel (10). Subsequently, a desired gas atmosphere is brought about in the discharge vessel (10) and the discharge vessel is closed. Finally, the holder (22) is opened. According to the invention, the holder (22) is made from a leadoxide containing glass, which leadoxide is partly reduced and in which the amount of reduction is a measure of the mercury content of the holder (22). Due to the reduction process holders (22) with different mercury contents have a different color.

8 Claims, 2 Drawing Sheets

LOW PRESSURE MERCURY DISCHARGE LAMP HAVING A MERCURY HOLDER WITH REDUCED LEAD OXIDE

BACKGROUND OF THE INVENTION

The invention relates to a method of manufacturing a low-pressure mercury vapor discharge lamp, in which method a closed holder containing a required quantity of mercury is placed in a radiation-transmitting discharge vessel, whereupon the discharge vessel is provided with a rare gas and is closed. Means for maintaining an electric discharge are arranged in or adjacent the discharge vessel, and the holder is opened after the discharge vessel has been closed.

The invention also relates to a holder containing mercury for use in a low-pressure mercury vapor discharge lamp manufactured by the above method.

The invention further relates to a low-pressure mercury vapor discharge lamp manufactured by means of this method.

A method of manufacturing a low-pressure mercury vapor discharge lamp of the kind mentioned in the first paragraph is known from U.S. Pat. No. 5,917,276. In the known method, a capsule or holder containing mercury and manufactured from glass is placed in a low-pressure mercury vapor discharge lamp, and the capsule or holder is opened in that it is locally heated through a wall portion of the discharge vessel by means of a radiation source.

The aim to reduce the quantity of mercury in the lamp, for example in counteracting that mercury is bound to lamp components in the discharge vessel during lamp operation and is thus no longer available for lamp operation, renders it desirable to use different mercury doses in dependence on the type and size of the low-pressure mercury vapor discharge lamp. A consequence of this is that the holders containing mercury will contain varying mercury doses for different lamp types.

SUMMARY OF THE INVENTION

The invention has for its object to ascertain in a simple manner what mercury dose is present in the holder.

Further objects of the invention are to provide a holder containing mercury for use in a low-pressure mercury vapor discharge lamp and to provide a low-pressure mercury vapor discharge lamp of the kind described in the opening paragraph which can be manufactured in a comparatively simple manner by the method according to the invention.

According to the invention, the holder is manufactured from a glass which comprises lead oxide, which lead oxide is partly reduced, the degree of reduction being a measure for the quantity of mercury in the holder.

A holder manufactured from glass and provided with a filling comprising mercury can be manufactured more easily than a holder made of ceramic material or metal. The introduction of impurities into the discharge vessel can be comparatively easily avoided with the use of a glass holder. A low melting temperature of the glass of the holder is favorable, i.e. a temperature at which the viscosity is 10 hpa. The holders can then be opened in a comparatively simple and fast manner, for example by means of a radiation source of low power. A suitable material having the desired properties for the manufacture of the glass envelope of the holder is a glass comprising lead oxide (the processing temperature T of PbO glass lies in the region of $1000° C. \leqq T \leqq 1500° C.$). The reduction of lead oxide to lead leads to a blackening of the glass. A partial reduction of lead oxide leads to a partial blackening of the glass. The manufacture of the holder from a glass comprising lead oxide and the reduction of the lead oxide to a higher or lower degree leads to a glass which has been blackened to a higher or lower degree. Given the desirability of using different mercury doses in the glass holder in dependence on the type and size of the low-pressure mercury vapor discharge lamp, the different degrees of blackening of the glass envelope of the holder provide a simple mechanism for distinguishing the various mercury doses. The introduction of impurities into the discharge vessel can be counteracted much better with the use of a holder manufactured from a glass comprising lead oxide, which lead oxide (PbO) is reduced partly to lead (Pb), than with the use of holders marked in a different way, for example with a paint mark on the outer surface of each holder. Paint and similar (organic or inorganic) products tend to give off solvents and other gases or vapors which are detrimental to the atmosphere in the discharge vessel. In addition, charged particles present in the discharge during operation of the low-pressure mercury vapor discharge lamp may promote the generation of vapors and gases from paint-like and similar products, which detract from an efficient discharge.

Preferably, the holder is light-transmitting for at least part of the visible spectrum. This simplifies an inspection of the contents of the holder. This may be achieved in that part of the holder is shielded from the reducing atmosphere during the reduction of the glass envelope of the holder. It is furthermore possible in this manner to blacken, for example, an end portion of the holder and/or a central portion of the holder.

It is favorable when the holder, while still closed, is filled with an inert gas,, for example a rare gas, with a filling pressure of between approximately 1 hPa and approximately 100 hPa. Leaky holders can be readily identified in that the holders are made to pass through a high-frequency inductive field. Undamaged holders, unlike leaky ones, will show a clearly visible disturbance (induction peak) while passing the field, following which the leaky holders can be removed from the production process by automatic detection means.

The holder is preferably colored as a result of the reduction of the lead oxide. The following colors on a gradual color scale are obtained in that the degree of reduction of the lead oxide to lead is made to vary: clear transparent (colorless), pale brown, brown, dark brown, and black. Such colors may be obtained through a suitable choice of the reduction conditions and/or through the use of suitable variations in the period over which the holder is reduced.

The lead oxide may be reduced by means of a heat treatment in an atmosphere comprising hydrogen. The heat treatment takes place preferably at temperatures between 450° C. and 500° C. and in a reducing atmosphere which comprises hydrogen ($H_2$) and nitrogen ($N_2$).

The lead oxide is preferably reduced mainly at an outer surface of the holder. The desired coloring of the holder is thus quickly obtained, said coloring being indicative of the quantity of mercury present in the holder. Since the major portion of the holder material consists of a glass comprising lead oxide in non-reduced form, a glass holder is obtained which for the remaining part has the desired properties (i.e. as regards the strength and stability of the glass envelope of the holder).

A low-pressure mercury vapor discharge lamp is thus obtained in a simple manner by the above method, which lamp can be manufactured in a comparatively simple manner by the method according to the invention.

Usually, the holder will remain inside the finished low-pressure mercury vapor discharge lamp after the manufacture of this lamp. It is favorable for the holder to be positioned in a recess of the discharge vessel in those lamps in which the holder in addition comprises an amalgam. The amalgam in the holder may have a comparatively low temperature, depending on the distance from the holder to the other lamp components. Alternatively, the holder may be arranged in a more central position in the discharge vessel, for example in the discharge space. Such an embodiment may be favorable when the holder was used exclusively for dosing mercury, or when the holder contains an amalgam which regulates the mercury vapor pressure required for an optimum lamp operation at a comparatively high temperature. If the discharge vessel is provided with a luminescent layer, a window may be provided therein for admitting radiation to the holder from outside the discharge vessel during lamp manufacture.

A holder remaining behind in the lamp is preferably fixed therein. A loose holder could give the impression that the lamp is defective. If the holder contains an amalgam, changes in the burning position could lead to variations in the amalgam temperature, and thus in the mercury vapor pressure, in the case of a loose holder. The holder may be fastened in the discharge vessel, for example, by means of glass fusion. A particularly suitable fastening spot for the glass holder is adjacent the electrodes of the low-pressure mercury vapor discharge lamp. A preferred embodiment of the low-pressure mercury vapor discharge lamp according to the invention is for this purpose characterized in that the means for maintaining an electric discharge comprise at least an electrode, an open electrode ring being arranged coaxially in the discharge vessel so as to surround the electrode, while the holder is fastened to said electrode ring.

BRIEF DESCRIPTION OF THE DRAWINGS

The Figures are purely diagrammatic and not drawn true to scale. Some dimensions have been particularly exaggerated for reasons of clarity. Similar components have been given the same reference numerals as much as possible in the Figures.

DETAILED DESCRIPTION OF THE PREFERRED EMBODIMENTS

Figure 1:
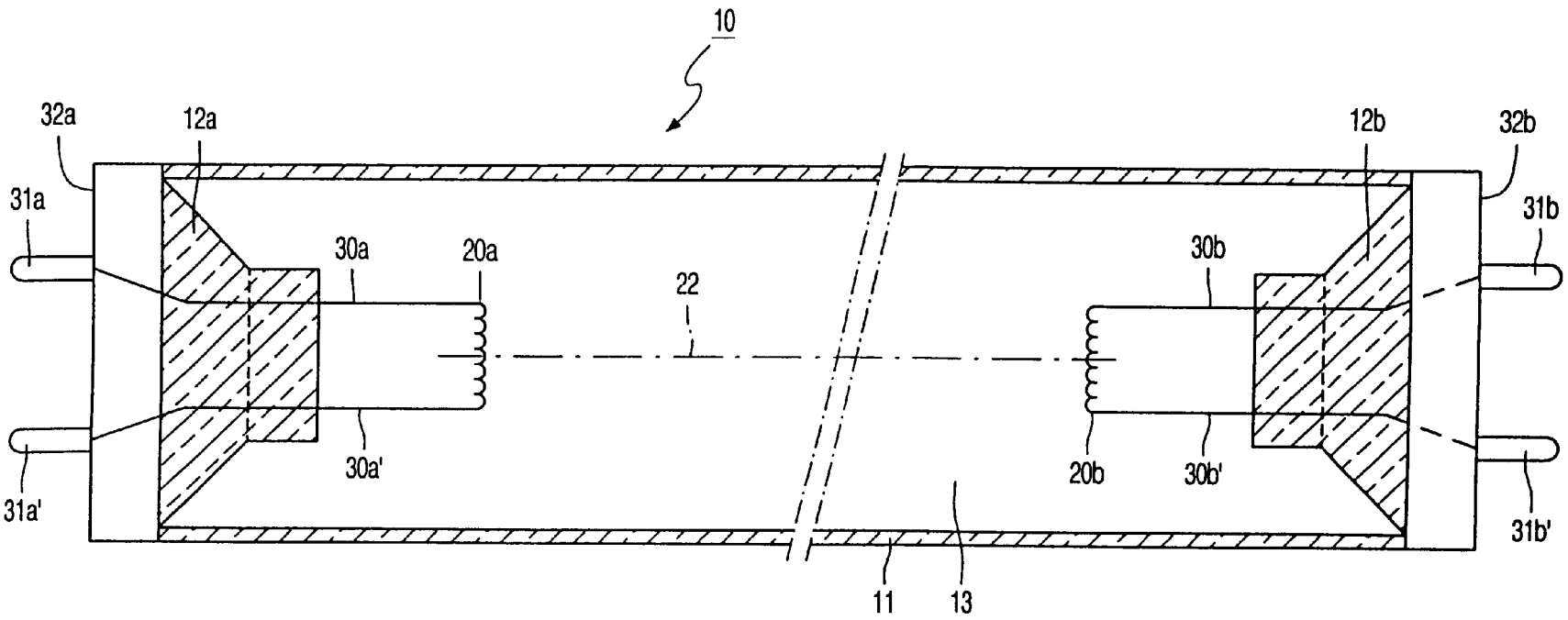
FIG. 1 shows a low-pressure mercury vapor discharge lamp according to the invention in longitudinal sectional view.
Figure 2:
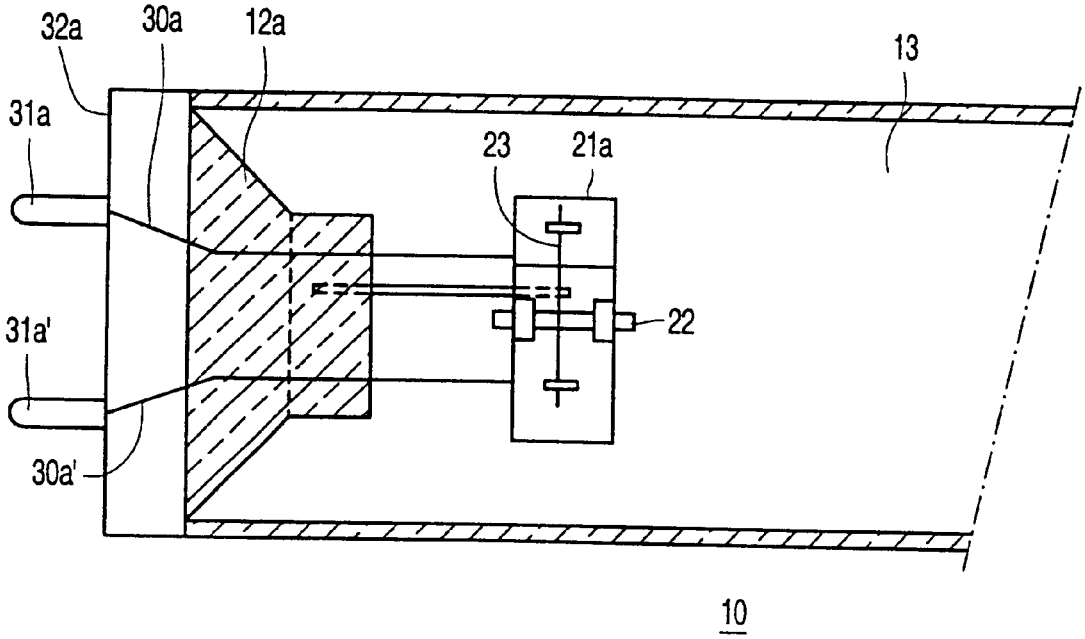
FIG. 2 shows a detail from FIG. 1.

FIG. 1 shows a low-pressure mercury vapor discharge lamp provided with a glass discharge vessel 10 with a tubular portion 11 which is translucent to radiation generated in the discharge vessel 10 and which has a first and a second end portion 12*a;* 12*b*. In this example, the tubular portion 11 has a length of 120 cm and an internal diameter of 2.6 cm. The discharge vessel 10 encloses a discharge space 13 in a gastight manner, said space being provided with a filling of mercury and a rare gas, for example argon or a mixture of krypton and argon (for example, a 3.7 hPa gas mixture of 75/25 Kr/Ar). The wall of the tubular portion is coated with a luminescent layer comprising a luminescent material (for example, a fluorescent powder) which converts the ultraviolet (UV) radiation generated through ionization of the mercury into (usually) visible light. The end portions 12*a;* 12*b* each support an electrode 20*a;* 20*b* arranged in the discharge space 13. Current supply conductors 30*a,* 30*a'*; 30*b,* 30*b'* extend from the electrodes 20*a;* 20*b* through the end portions 12*a;* 12*b* to outside the discharge vessel 10. The current supply conductors 30*a,* 30*a'*; 30*b,* 30*b'* are connected to contact pins 31*a,* 31*a'*; 31*b,* 31*b'* which are fastened to respective lamp caps 32*a;* 32*b*. An electrode ring is arranged around each electrode 20*a;* 20*b*. FIG. 2 shows such an electrode ring 21*a* surrounding the electrode 20*a* (the electrode 20*a* is not shown in FIG. 2). A glass holder or capsule 22, with which mercury was dosed, is clamped on the electrode ring 21*a*. For dosing, a metal wire 23 tensioned over the glass holder 22 was inductively heated in a high-frequency electromagnetic field, so that the holder 22 was cut through and the mercury to be dosed was released from the holder 22 into the discharge space 13.

In the method according to the invention, the holder or capsule 22 is preferably manufactured partly from lead oxide (a particularly suitable holder comprises 20% PbO), which lead oxide is reduced to lead, in particular at the outer surface of the glass envelope of the holder 22, a portion of the outer surface of the envelope becoming colored, for example, black so as to correspond to the required mercury dose in the glass holder 22. The degree of reduction of the lead oxide forms an indication as to the quantity of mercury contained in the holder 22. In the example described with reference to FIG. 1, where the low-pressure mercury vapor discharge lamp contains 3 mg mercury, an at least substantially black glass holder 22 is used, which is fastened to the electrode ring 21*a*. Other properties of the contents of the holder 22 may also be indicated by means of a suitable reduction of the lead oxide. This may relate inter alia to the indication as to whether the holder contains a rare gas and/or an amalgam. Besides lead oxide (PbO), the material of the glass holder 22 may in addition comprise, for example, a few % by weight of the oxides FeO, CuO and/or $V_2O_3$. It is possible to provide the rare gas filling from the holder 22 after sealing of the discharge vessel 10 instead of providing the discharge vessel 10 of the low-pressure mercury vapor discharge lamp with a filling of a rare gas before it is sealed.

It will be obvious that many variations will be possible to those skilled in the art within the scope of the invention.

The invention resides in each new characteristic and in each combination of characteristics.

What is claimed is:

1. A method of manufacturing a low-pressure mercury vapor discharge lamp comprising:

placing a holder containing a quantity of mercury in a radiation-transmitting discharge vessel, providing the discharge vessel with a rare gas and means for maintaining an electric discharge, closing the discharge vessel, and opening the holder after the discharge vessel has been closed, wherein the holder is manufactured from a glass which comprises lead oxide, and a portion of said lead oxide is reduced to lead, the degree of reduction being a measure for the quantity of mercury in the holder.

2. A method as claimed in claim 1, wherein the holder becomes colored as a result of the reduction of the lead oxide.

3. A method as claimed in claim 1, characterized in that the lead oxide is reduced by means of a heat treatment in an atmosphere comprising hydrogen.

4. A method as claimed in claim 1, wherein the lead oxide is reduced mainly at an outer surface of the holder.

5. A holder containing mercury for use in a low-pressure mercury vapor discharge lamp, said holder being manufactured of glass containing lead oxide, wherein a portion of said lead oxide is reduced to lead prior to said use.

6. A low-pressure mercury vapor discharge lamp comprising a mercury holder being manufactured of glass containing lead oxide, wherein a portion of said lead oxide is reduced to lead prior to use of said mercury holder in said lamp.

7. A low-pressure mercury vapor discharge lamp as claimed in claim 6, comprising means for maintaining an electric discharge comprising an electrode, an open electrode ring being arranged coaxially in the discharge vessel so as to surround the electrode, while the mercury holder is fastened to said electrode ring.

8. A method of forming a holder comprising:

forming said holder from a glass that contains lead oxide;

changing a color of at least a portion of said glass by reducing a portion of said lead oxide to lead; and associating said color with a content of said holder.

* * * * *